United States Patent [19]

Garapick et al.

[11] Patent Number: 4,706,424

[45] Date of Patent: Nov. 17, 1987

[54] FLOOR MODULE STRUCTURE

[76] Inventors: Ronald T. Garapick; Peter J. Garapick, both of 1813 Alvin Ave., Cleveland, Ohio 44109

[21] Appl. No.: 846,719

[22] Filed: Apr. 1, 1986

[51] Int. Cl.[4] ..... B65D 19/26

[52] U.S. Cl. ..... 52/181; 108/51.1; 404/17; 52/506; 52/811; 52/828

[58] Field of Search ..... 52/120.6, 181, 506, 52/511, 811, 813, 821, 309, 602, 827, 828, 782; 108/51.1; 404/17, 18, 32

[56] References Cited

U.S. PATENT DOCUMENTS

| | | | |
|---|---|---|---|
| 1,632,395 | 6/1927 | Fellows | 404/32 |
| 1,645,622 | 10/1927 | Prince | 52/181 |
| 1,935,823 | 11/1933 | Turner | 404/46 |
| 2,337,278 | 12/1943 | Schmitz | 52/585 |
| 2,437,095 | 3/1948 | Kahr | 404/18 |
| 2,478,993 | 8/1949 | Wing | 52/811 |
| 2,969,983 | 1/1961 | De Vore | 52/782 |
| 3,059,887 | 10/1962 | Ward | 108/51.1 |
| 3,245,185 | 4/1966 | Rowe | 52/220 |
| 3,302,361 | 2/1967 | Oudheusden et al. | 52/828 |
| 3,887,736 | 6/1975 | Kaswell | 52/181 |
| 3,967,428 | 7/1976 | Pierce et al. | 52/828 |
| 3,999,397 | 12/1976 | Albery | 52/811 |

FOREIGN PATENT DOCUMENTS

| | | | |
|---|---|---|---|
| 218453 | 1/1968 | Sweden | 52/126.6 |
| 3397 | of 1893 | United Kingdom | 404/69 |
| 1086175 | 10/1967 | United Kingdom | 52/827 |
| 1560692 | 2/1980 | United Kingdom | 52/181 |

*Primary Examiner*—James L. Ridgill, Jr.
*Attorney, Agent, or Firm*—John M. Romanchik, Jr.

[57] ABSTRACT

A floor module structure is disclosed comprising a wearing surface such as a cemmentitious compound or a laminate of wood strips attached to a steel plate base that is supported by a plurality of spaced steel bars welded to the underside of the plate for vertical support for sustaining heavy dynamic and static loads.

6 Claims, 3 Drawing Figures

FLOOR MODULE STRUCTURE

BACKGROUND OF THE INVENTION

The present invention relates to modular flooring construction for installation in a building and particularly in a steel frame building where it is necessary to provide structural flooring that will span the openings between horizontal building floor joists, beams or channels and yet have sufficient load bearing strength to carry extremely heavy dynamic and static loads.

Previously, flooring in the prior art was made solely of laminated wood parquet modules but were not supported on a base such as the base plate in the present invention. Consequently, the wood flooring would fracture and break up and complete replacement would be necessary.

The present invention overcomes the problems of the prior art by providing a stronger flooring due to the wearing surface being supported on a base plate which is placed on horizontal longitudinal bars. This greatly reduces the fracturing of the wearing surface which, even if it should crack, the flooring still remains serviceable as it will not break up since the base plate upon which the wearing surface rests still remain intact and will continue to carry and support the wearing surface and load.

SUMMARY OF THE INVENTION

In accordance with the present invention, there is provided an improved floor module structure comprising a wearing surface such as cemmentitious compound or a laminate of wood strips attached to a steel base that is supported by a plurality of spaced steel bars welded to the underside of the plate for vertical support for sustaining heavy dynamic and static loads.

Accordingly it is an object of the invention to provide an improved floor module structure.

It is still another object of the invention to provide a floor module structure capable of carrying extremely heavy loads while limiting vertical deflection or yield.

Other objects and advantages of the invention will become apparent from the description which follows when taken in conjunction with the accompanying drawings.

DETAILED DESCRIPTION OF THE INVENTION

Figures 1, 2, 3:
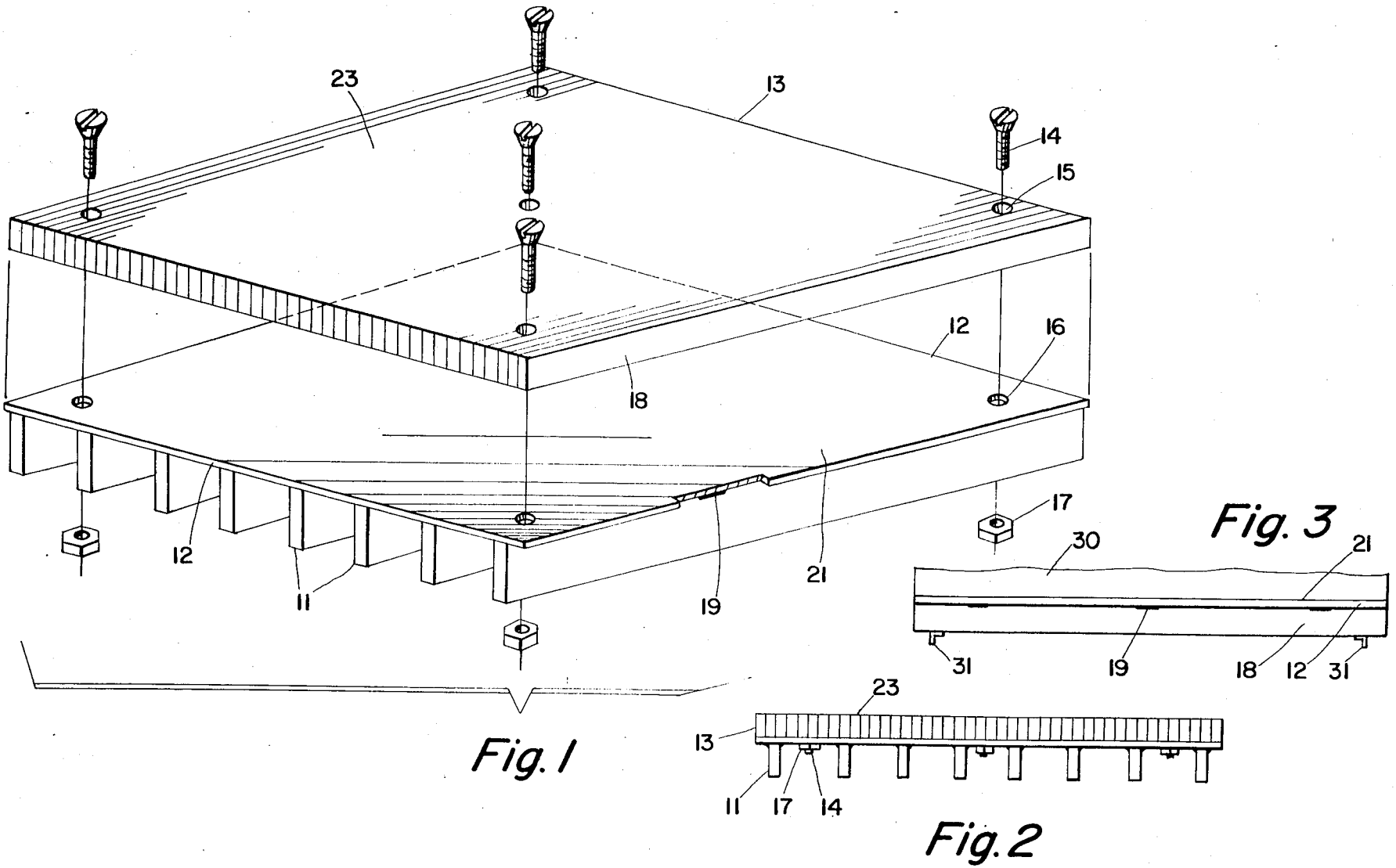
FIG. 1 is an exploded perspective view of the floor module structure according to the invention.
FIG. 2 is front elevation end view of the assembled invention of FIG. 1.
FIG. 3 is a side view of another embodiment of the invention.

Referring to FIG. 1, there is illustrated the floor module structure shown generally at 10 according to one embodiment of the invention. The floor module 10, when placed in a building, is of sufficient length and width size such as thirty inches by thirty inches, to span the opening between floor joist beams of a structural steel frame building and can be enlarged or reduced in any dimension to span the openings as required. When installed along with other similar floor modules of the invention side by side, together they comprise a complete flooring capable of supporting extremely heavy loads such as from steel loaded traveling fork lifts or piled stacks of stored steel. The floor module 10 can be used in other settings such as, on a full ground floor pad, but is particularly important when used for spanning an opening.

A base plate 12 as seen in FIG. 1 and FIG. 2 has a plurality of spaced bars 11 affixed to the plate bottom side and extending longitudinally under said plate to provide vertical support. The base plate 12 can be made of suitable material and thickness as required by a particular application. However, it has been found that steel plate accommodates most all requirements since it has the strength to resist yielding and most applications require a strong floor. There are longitudinal bars 11 affixed to the bottom of base plate 12 and extending longitudinally to provide the main vertical support for heavy load carrying capacity for the floor module 10. The bars 11 are preferably made of steel also, which then can be affixed by welding as shown at 19 to the bottom side 20 of the base plate 12. In a typical example, base plate 12 of mild carbon steel would be $\frac{1}{4}''$ plate and longitudinal bars 11 of mild carbon steel would measure $1''$ by $2\frac{1}{4}''$ in cross section.

A replaceable wearing surface such as a laminate of treated hard wood strips 13 as illustrated in FIG. 1 is used to accomodate the abusive wear from wheeled material handling equipment such as fork lift trucks. Other strip materials suitable for a laminate may be used in situations where extreme dynamic loading from traveling trucks is not present. However, a laminate 13 of treated hardwood strips that are cemented together by methods well known in the art are preferred for their wear resistance durability and when treated, for their resistance to destructive fluids such as oils, chemicals and water. The wearing surface laminate 13 is removably affixed to the base plate 12 by bolting it with a plurality of threaded bolts 14 placed in a countersunk hole 15, which is obviously countersunk to have a flat top surface 23 to avoid damage to tires and avoid workers tripping. The laminate 13 is held in place on base plate 12 by tightening together by turning nuts 17 or turning threaded bolts 14 while holding the other in place. Laminate 13 may also be affixed by cementing it to top surface 21 or by other suitable methods.

Other wearing surfaces 30 may be used according to user preferences as shown in FIG. 3, another embodiment of the invention. The wearing surface 30 material may be of cementitious compounds such as ordinary cement, a polymer cement, or epoxy compounds and are molded or hydraulically pressed and then affixed by cementing to top surface 21 of base plate 12.

In constructing the floor module 10 it has been found that by affixing cross bars 31 transverse to longitudinal bars 11 across the bottoms thereof as shown in FIG. 3, it facilitates assembling them together. Cross bars 31 are preferably mild carbon steel angle stock and are affixed by welding to the bottom of longitudinal bars 11. Cross bars 31 serve to aid in construction by holding longitudinal bars 11 in position for affixing to the bottom 20 of base plate 12. Cross bars 31 further serve to insure that the assembly of the base plate 12 and longitudinal bars 11 provides a flat top surface 21 for receiving laminate 13. It can be appreciated that if base plate 12 top surface 21 is warped, laminate 13 may fracture when carrying a load. When the assembled floor module 10 is placed in a building on floor joists, it may slide when traveling material handling vehicles accellerate or apply brakes. Cross bars 31 are affixed at both ends and transverse or across longitudinal bars 11, and are located at a position to abut the building floor joists such that when floor assembly 10 is put in place in a building, cross bars 31 will abut the building floor joists and prevent floor module 10 from sliding out of place.

While specific embodiments of the invention have been described and illustrated, it is to be understood that the invention is not to be construed as being limited thereto, but only by the proper scope of the following claims.

We claim:

1. A floor module structure, comprising a steel base plate, a plurality of steel longitudinal spaced bars welded to the bottom side of said base plate and extending longitudinally under said base plate to provide vertical support for limiting vertical deflection when sustaining heavy loads, said base plate having a top surface, a wearing surface material affixed to and covering said base plate top surface, a plurality of steel cross bars welded transverse across the bottom of said longitudinal bars at the ends and extending the width from one bar to another for providing holding support of said longitudinal bars in position when assembling and for providing stiffening and limiting vertical deflection during fabricating of said floor module to provide a flat base plate top surface and said cross bars are angle bars.

2. A floor module structure as defined in claim 1, wherein said wearing surface material is a plurality of longitudinal floor strips affixed to each other to form a laminate, said laminate is affixed to said base plate, and said laminate of longitudinal strips substantially covers and extends over the length and width of said base plate thereby providing a wearing surface material on a firm base for supporting extremely heavy dynamic and static loads.

3. A floor module structure as defined in claim 2, wherein said floor strips are wood strips cemented together side by side to form said laminate and said laminate is affixed to said base plate top surface by tightening together with a plurality of threaded bolts and nuts.

4. A floor module structure as defined in claim 1, wherein said wearing surface material is a cementitious compound affixed to and covering the top surface of said base plate.

5. A floor module structure as defined in claim 4, wherein said cementitious compound is concrete.

6. A floor module structure as defined in claim 4, wherein said cementitious compound is an epoxy compound.

* * * * *